US009013316B2

(12) United States Patent
Mokhtari et al.

(10) Patent No.: US 9,013,316 B2
(45) Date of Patent: Apr. 21, 2015

(54) SMOKE DETECTOR

(75) Inventors: Zohreh Mokhtari, Issy-les-Moulineaux (FR); Stéphane Hole, Paris (FR); Jacques Lewiner, Saint-Cloud (FR)

(73) Assignees: Finsecur, Nanterre (FR); Institut pour le Developpement de la Science, l'Education et la Technologie (IDSET), Paris (FR)

( * ) Notice: Subject to any disclaimer, the term of this patent is extended or adjusted under 35 U.S.C. 154(b) by 448 days.

(21) Appl. No.: 13/192,633

(22) Filed: Jul. 28, 2011

(65) Prior Publication Data

US 2013/0027211 A1 Jan. 31, 2013

(51) Int. Cl.
*G08B 17/10* (2006.01)
*G08B 17/11* (2006.01)

(52) U.S. Cl.
CPC ..... *G08B 17/11* (2013.01) 340/693.6; 340/870.09

(58) Field of Classification Search
USPC ..... 340/628–630, 632, 693.6, 870.09
See application file for complete search history.

(56) References Cited

U.S. PATENT DOCUMENTS

| | | | | |
|---|---|---|---|---|
| 3,744,898 | A * | 7/1973 | Kurahashi et al. | 399/153 |
| 3,908,957 | A * | 9/1975 | Schutt | 250/384 |
| 3,949,390 | A * | 4/1976 | Rayl et al. | 340/629 |
| 4,053,769 | A * | 10/1977 | Nishikawa et al. | 250/324 |
| 4,176,311 | A * | 11/1979 | Davis | 324/468 |

(Continued)

FOREIGN PATENT DOCUMENTS

JP 2006146296 A * 6/2006

OTHER PUBLICATIONS

Zohreh Mokhtari et al., "Electrostatic smoke sensor", 7th Conference of the French Society of Electrostatics SFE 2010, Montpellier, France, Aug. 30, 2010-Sep. 1, 2010.

(Continued)

*Primary Examiner* — Benjamin Lee
*Assistant Examiner* — Quang D Pham
(74) *Attorney, Agent, or Firm* — Young & Thompson

(57) ABSTRACT

The smoke detector comprises a housing provided with one or more openings for the passage of smoke particles into an interior of the housing. A first electrode and a second electrode are disposed in the interior of the housing and generate an electric field by application of an electrical potential therebetween. A detection chamber is defined between the first electrode and the second electrode, the detection chamber comprising an ionization zone for the generation of charged particles by ionization of air in the vicinity of the second electrode and a drift zone for the movement of charged particles towards the first electrode. A measurement device measures an electrical parameter representative of the electrical current generated between the first electrode and the second electrode by the charged particles. The electrical potential between the first electrode and the second electrode is maintained at a first electrical potential level which is less than and in the vicinity of an electrical potential threshold level at which at corona phenomenon is generated such that in the absence of smoke no corona phenomenon is generated in the vicinity of the second electrode and in the presence of smoke a corona phenomenon is generated in the vicinity of the second electrode.

14 Claims, 5 Drawing Sheets

(56) References Cited

U.S. PATENT DOCUMENTS

| | | | | | |
|---|---|---|---|---|---|
| 4,238,788 | A * | 12/1980 | Rosauer et al. | 340/515 |
| 4,336,454 | A * | 6/1982 | Bryant et al. | 250/381 |
| 4,361,031 | A * | 11/1982 | Perry et al. | 73/61.51 |
| 4,488,044 | A * | 12/1984 | Rork et al. | 250/381 |
| 4,652,866 | A * | 3/1987 | Siegmann et al. | 340/628 |
| RE32,552 | E * | 12/1987 | Liebermann et al. | 340/632 |
| 5,400,015 | A * | 3/1995 | Liebermann | 340/632 |
| 5,907,468 | A * | 5/1999 | Muz | 361/213 |
| 6,967,582 | B2 * | 11/2005 | Tice et al. | 340/630 |
| 7,226,496 | B2 * | 6/2007 | Ehlers | 95/2 |
| 7,417,553 | B2 * | 8/2008 | Young | 340/628 |
| 2002/0089283 | A1 * | 7/2002 | Francke et al. | 313/539 |
| 2004/0026621 | A1 * | 2/2004 | Hayn | 250/311 |
| 2005/0098040 | A1 * | 5/2005 | Billiotte et al. | 96/15 |
| 2005/0098720 | A1 * | 5/2005 | Traynor et al. | 250/288 |
| 2006/0112828 | A1 * | 6/2006 | Ehlers | 96/63 |
| 2006/0125648 | A1 * | 6/2006 | Young | 340/628 |
| 2008/0252473 | A1 * | 10/2008 | Fink | 340/629 |
| 2011/0220811 | A1 * | 9/2011 | Dick et al. | 250/424 |

OTHER PUBLICATIONS

P. Atten et al., "Simulation of Corona Discharge in Configurations with a Sharp Electrode", Journal of Optoelectronics and Advanced Materials, Sep. 2004, pp. 1023-1028, vol. 6, No. 3.

Manuel Arrayas et al., "Ionization fronts in negative corona discharges", Phys., Rev. E, 2005, pp. 1-4, vol. 71.

* cited by examiner

SMOKE DETECTOR

BACKGROUND OF THE INVENTION (1) Field of the Invention

The present invention concerns a smoke detecting device and a method of detecting smoke. Embodiments of the invention may be applied to the detection of a fire by detection of fine particles and aerosols contained in smoke emitted by a fire.

(2) Description of Related Art

Smoke is one of the first indicators of the presence of a fire. Consequently, detection of smoke may be used to alert people of the presence of a fire in a building enabling them to escape the effects of a fire in time or to put out the fire. Moreover, in the case of nocturnal fires a smoke sensor fitted with an audible alarm may awaken and warn inhabitants of the presence of a fire.

In order to detect the presence of smoke two different types of physical phenomena are typically used. The first type of physical phenomenon involves the diffusion of light by the smoke, dust or associated aerosols. The second type of physical phenomenon exploited in the detection of smoke is the modification by the presence of smoke particles of the speed of movement of ions in the presence of an electric field.

In the case of optical smoke sensors based on the diffusion of light, two operating modes are generally implemented. In the first operating mode, smoke particles block the light between an emitter, for example a light emitting diode (LED) and a receptor, for example phototransistor. The subsequent reduction of light reaching the receptor triggers an alarm. Such sensors are often referred to as reduction optic sensors. In the second operating mode, which tends to be more commonly used, smoke particles diffuse light coming from the emitter and a part of the diffused light is received by a receptor. The signal received by the receptor is then small in absence of smoke but increases significantly in the presence of smoke. When the scattered light reaches the receptor, an alarm is triggered. Such smoke sensors are often referred to as diffusion optic sensors.

Although optical smoke sensors respond rapidly to smouldering fires, reduction optic sensors are efficient only when there is a large distance between the light emitter and the light receptor while diffusion optic sensors are not efficient for the detection of combustion gas or dark smoke which are the first signs of a fire. Moreover light emitters require a substantial electrical power supply, which can be a serious drawback when the sensor operates on batteries, leading to a reduced operating time.

Smoke detectors based on the movement of electrically charged particles, or ions, comprise a source of ionization for the generation of charged particles and a drift chamber in which the charged particles can slowly move under the influence of an electric field between electrodes polarized at low voltage. The movement of the ions in the electric field created between the electrodes generates a measurable continuous electric current. When smoke particles enter the drift chamber, they attach to the charged particles, neutralize them or reduce their speed of movement resulting in a significant drop in measured current between the electrodes. The drop in current triggers an alarm. This type of smoke detectors is generally referred to as ionization detectors.

Ionization detectors tend to respond more rapidly and with a reduced amount of smoke particles compared to optical sensors to flaming fires emitting smaller particles. In order to create charged particles, radioactive materials such as americium-241 were previously used. However, owing to new standards, commercialization of such smoke detectors is restricted because of the presence of the radioactive source in the smoke detector.

Another way of creating the charged particles is to use an electrical discharge such as those referred to as corona discharges. In such a way it is possible to generate ions without using a radioactive source. However such devices require a relatively high voltage to produce the ionization of the surrounding gas (air) which, even with a low ionic current (but a high voltage), requires a relatively high current at the power supply level since it is at a low voltage. This again can be a serious drawback when the sensor operates on batteries, leading to a reduced operating time. Moreover the current due to a corona discharge depends significantly on parameters such as air pressure, humidity, etc which can be another serious drawback. Indeed, in a traditional ionic smoke detector the current is measured and an alarm is triggered when the measured current changes by a given percentage. As a consequence it is difficult to detect the difference between the presence of smoke or a change of environmental conditions.

BRIEF SUMMARY OF THE INVENTION

The present invention has been devised to address one or more of the foregoing concerns.

According to a first aspect of the invention there is provided a smoke detector comprising: a housing provided with one or more openings for the passage of smoke particles into an interior of the housing; a first electrode and a second electrode disposed in the interior of the housing for generating an electric field by application of an electrical potential therebetween; a detection chamber defined between the first electrode and the second electrode, the detection chamber comprising an ionisation zone for the generation of charged particles by ionisation of air in the vicinity of the second electrode and a drift zone for the movement of charged particles towards the first electrode; a measurement device for measuring an electrical parameter representative of the electrical current generated between the first electrode and the second electrode by the charged particles; wherein the electrical potential between the first electrode and the second electrode is maintained at a first electrical potential level which is less than and in the vicinity of an electrical potential threshold level at which at corona phenomenon is generated such that in the absence of smoke no corona phenomenon is generated in the vicinity of the second electrode and in the presence of smoke a corona phenomenon is generated in the vicinity of the second electrode.

In embodiments, the first electrode is of planar form and the second electrode is a wire arranged parallel to the first electrode.

In embodiments, the first electrode is of cylindrical form and the second electrode is a wire disposed within the first electrode along the longitudinal axis of the first electrode.

In embodiments, the first electrode is perforated.

In embodiments, the second electrode is a conductor with a sharp tip facing towards the first electrode which has at least one portion of planar shape.

In embodiments, the second electrode is held at a positive electrical potential with respect to the first electrode.

In embodiments, the first electrical potential level is in the range of from 400V to 1000V with respect to the first electrode.

In embodiments, a metallic shielding grid connected to ground potential is provided to prevent the entrance of stray ions inside the detection chamber.

In embodiments, the electrical potential threshold level is in a range of from 400V to 500V.

In embodiments, the first electrode has a diameter in the range of from 30 mm to 50 mm and the second electrode has a diameter in the range of from 20 μm to 30 μm.

In embodiments, the second electrode has a curvature radius of the tip of less than 30 μm.

BRIEF DESCRIPTION OF THE FIGURES

Embodiments of the invention will now be described, by way of example only, and with reference to the following drawings in which.

DETAILED DESCRIPTION OF THE INVENTION

Figure 1:
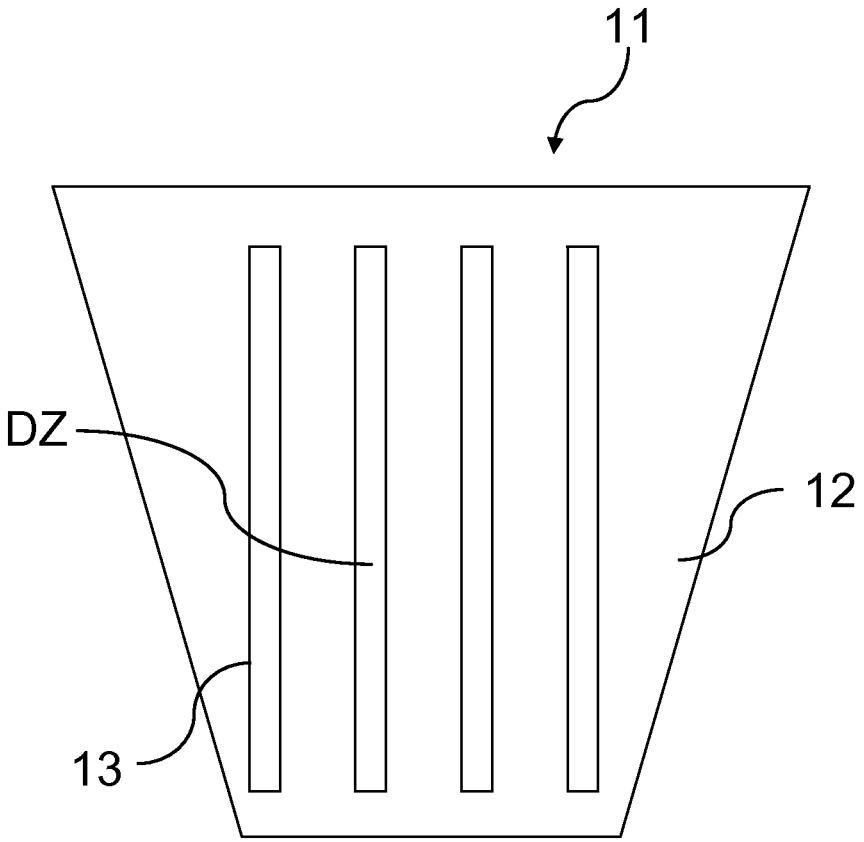
FIG. 1 is a schematic diagram of the exterior of a smoke detector according to one or more embodiments of the invention.
Figure 2A:
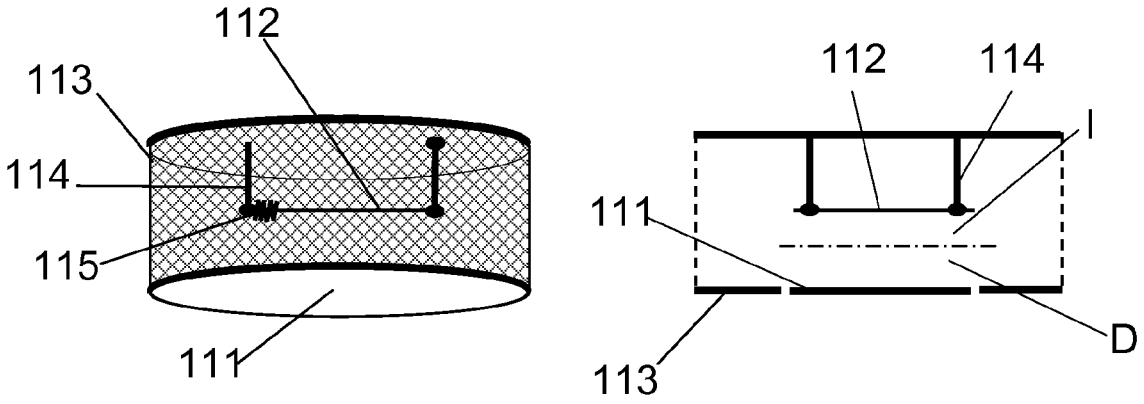
FIGS. 2A to 2C are schematic diagrams of the arrangement of electrodes within a smoke detector according to a first, second and third embodiments of the invention respectively.

FIG. 1 is a schematic illustration of the exterior of a smoke detector 11 according to a general embodiment of the invention. The smoke detector 11 includes a smoke detection chamber 12 provided with openings 13 to allow the passage of air and smoke particles through a detection zone DZ within the smoke detection chamber 12. FIG. 2A is a schematic illustration of a configuration of a smoke detector according to a first embodiment of the invention. A first electrode 111 and a second electrode 112 are arranged within the detection chamber 12. The first electrode 111 is configured in the shape of a plate and the second electrode 112 is constituted of a wire arranged substantially parallel to the first electrode 111. With reference to the right part of FIG. 2A the zone defined between the first electrode 111 and the second electrode 112 comprises a ionisation zone I surrounding and proximal to the second electrode 112 and a drift zone D located between the ionisation zone I and the first electrode 111. In the ionisation zone I, ions are formed and in the drift zone D the ions move towards the first electrode 111 which acts as a charge collecting electrode.

Figure 2B:
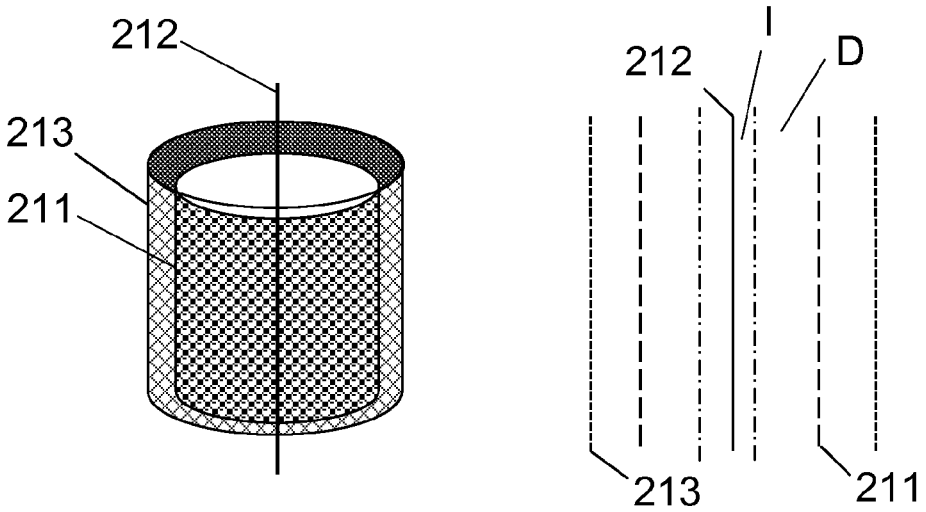

In a second embodiment of the invention as illustrated in FIG. 2B the first electrode 211 is configured in the shape of a cylinder and the second electrode 212 is constituted of a wire arranged along the longitudinal axis of the first cylindrical electrode 211. With reference to the right part of FIG. 2B the zone defined between the first electrode 211 and the second electrode 212 comprises a cylindrical ionisation zone I surrounding and proximal to the second electrode 212 and a drift zone D located between the ionisation zone I and the first electrode 211. In the ionisation zone I, ions are formed and in the drift zone D the ions move towards the first electrode 211 which acts as a charge collecting electrode.

Figure 2C:
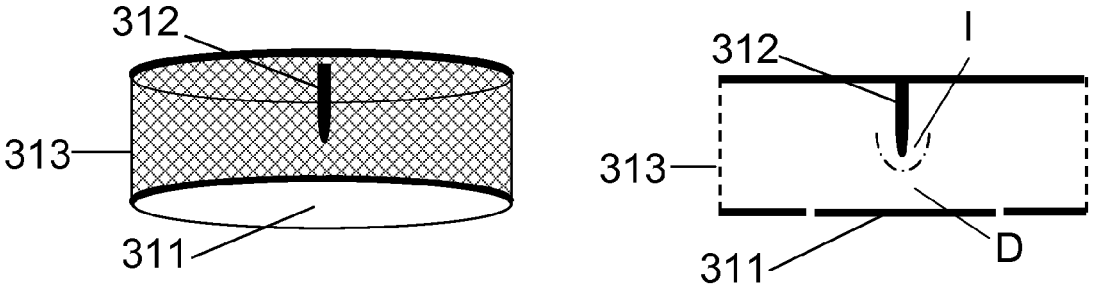

In a third embodiment of the invention as illustrated in FIG. 2C the first electrode 311 is configured in the shape of a plate and the second electrode 312 is constituted of at least one sharp tipped electrode facing towards the electrode 311. With reference to the right part of FIG. 2C, the zone defined between the first electrode 311 and the second electrode 312 comprises an ionisation zone I surrounding the tip of the second electrode 312 and a drift zone D located between the ionisation zone I and the first electrode 311. In the ionisation zone I, ions are formed and in the drift zone D the ions move towards the first electrode 311 which acts as a charge collecting electrode.

Figure 3:
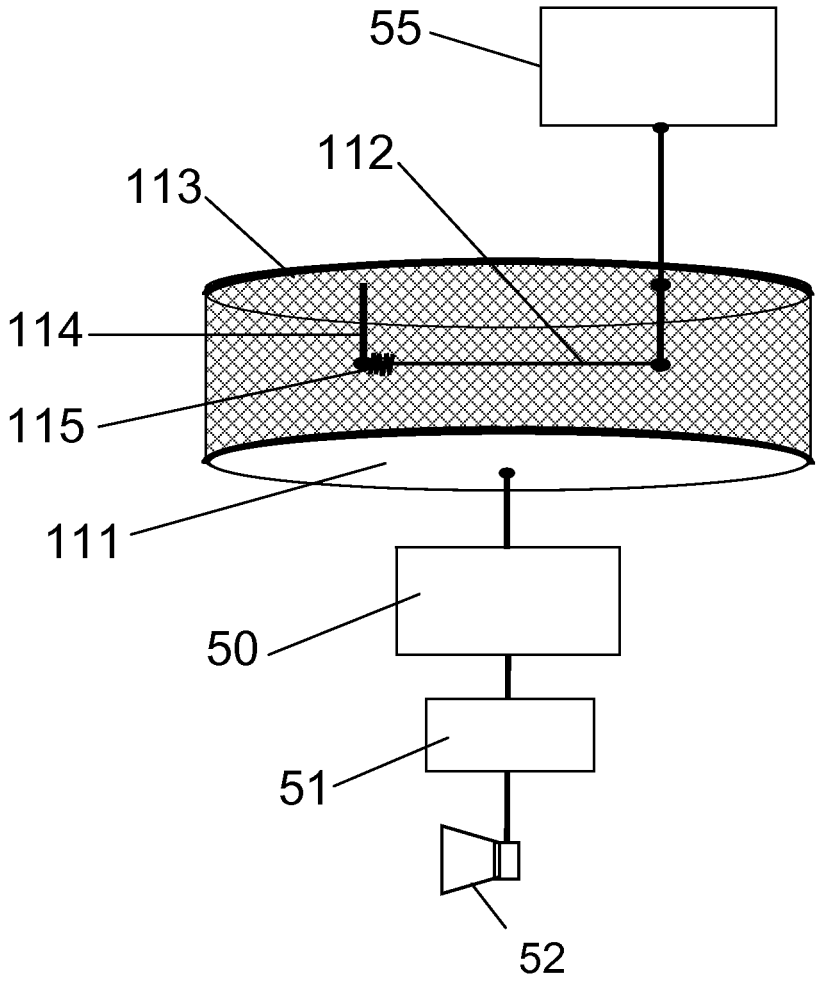
FIG. 3 is a schematic block diagram of elements of a smoke detector according to the first embodiment of the invention.

The second electrode (112, 212, 312) of each embodiment is connected to a high voltage power supply 55, shown on FIG. 3, operable to supply a voltage of at least 400V and preferably a positive voltage in the range of 500-1000V with respect to the second electrode.

In the particular embodiment shown in FIG. 2A, the second electrode 112 is made of a gold coated tungsten wire of approximately 25 μm diameter. Isolated spacers 114 are provided to hold the second electrode 112 at a distance of approximately 18 mm away from the first electrode 111. The second electrode 112 is held at a positive intermediate voltage in a range of 400 to 1000V, and is stretched by a spring 115.

In the particular embodiment shown in FIG. 2B, the second electrode 212 is made of a gold coated tungsten wire of approximately 25 μm diameter centered in a 36-mm diameter perforated metallic cylindrical first electrode 211. The second wire electrode 212 is held at a positive intermediate voltage in a range of from 400 to 1000V.

In the particular embodiment shown in FIG. 2C, the second electrode 312 is made of at least one tipped shaped electrode in which the radius of curvature of the tip is less than 30 μm and preferably less than 12 μm. The electrode can be made of a metal, carbon nanotubes or any other conducting material. The second electrode 312 is held at a distance of between 5 and 20 mm from the first electrode 311. The second electrode 312 is held at a positive intermediate voltage in a range of from 400 to 1000V.

In the particular embodiments shown in FIGS. 2A to 2C, a metallic grid shielding (113, 213, 313) connected to ground potential surrounds the respective detection chamber to prevent the ingress of stray charged particles in the air which may affect the smoke detection function of the smoke detector.

In embodiments:

- the first electrode is of planar form and the second electrode is a wire arranged parallel to the first electrode;
- the first electrode is of cylindrical form and the second electrode is a wire disposed within the first electrode along the longitudinal axis of the first electrode;
- the first electrode is perforated;
- the second electrode is a conductor with a sharp tip facing towards the first electrode which has at least one portion of planar shape;
- the second electrode is held at a positive electrical potential with respect to the first electrode;
- the first electrical potential level is in the range of from 400V to 1000V with respect to the first electrode;
- a metallic shielding grid connected to ground potential is provided to prevent the entrance of stray ions inside the detection chamber;
- the electrical potential threshold level is in a range of from 400V to 500V;
- the first electrode has a diameter in the range of from 30 mm to 50 mm and the second electrode has a diameter in the range of from 20 μm to 30 μm and/or
- the second electrode has a curvature radius of the tip of less than 30 μm.

As illustrated in FIG. 3 for the first embodiment the first electrode (111, 211, 311) is grounded via an amplifier 50 which is operable to measure an electric current as low as $10^{-14}$ A. The signal measured by the amplifier 50 is regularly acquired by a processor 51 for processing. Processing of the signal issued by the amplifier may involve comparing the signal with a trigger threshold level for triggering an alarm 52 to emit an audible alarm indicative of the presence of smoke. In some embodiments a visible signal may be emitted to indicate an alarm. In another embodiment the alarm may be transmitted to a central surveillance unit, by wire or wirelessly (radio or light).

An electric field E is created between the first electrode (111, 211, 311) and the second electrode (112, 212, 312) by applying a high positive voltage to the second electrode (112, 212, 312) with respect to the first electrode (111, 211, 311). The first electrode may be maintained at ground, for example. The second electrode (112, 212) in the form of a wire or 312 in the form of tip, is held at positive voltage so that a positive corona discharge may occur in the ionisation zone I and the resulting positive ions drift through the drift zone D towards the first electrode (111, 211, 311). The voltage needed to ionize the molecules of air between the first electrode (111, 211, 311) and the second electrode (112, 212, 312) depends on different parameters such as the ionization energy, the presence of particles, the gas pressure, the distance between the electrodes and their shape. The following documents which are incorporated herein by reference thereto present examples of conditions for providing corona discharge: F. W. Peek, Dielectric phenomena in H.V. engineering, Mc Grow Hill, 1929; P. Atten, K. Adamiak, B. Khaddour, J.-L. Coulomb, "Simulation of corona discharge in configurations with a sharp electrode", *Journal of Optoelectronics and Advanced Materials*, Vol. 6, pp. 1023-1028, 2004; N. Oussalah, Y. Zebboudj, "Negative corona compution in air", *Engineering with Computers*, pp. 296-303, 2006; and M. Arrayas, M. A. Fontelos, J. L. Trueba, "Ionization fronts in negative corona discharges", *Phys. Rev. E*, Vol. 71, 2005.

During a corona discharge, the space between the first electrode and the second electrode is divided into the two distinct regions described above: (i) a high field ionization region I surrounding the second electrode (112, 212, 312) where the ions are created and (ii) a low field drift region D occupying the remaining space between the two electrodes (111, 211, 311) and (112, 212, 312). These two distinct regions are illustrated in part (ii) FIGS. 2A to 2C.

In air, and in the absence of smoke, the voltage threshold at which a corona phenomenon will be triggered is strongly dependent on the wire diameter of the second electrode (112, 212), or the radius of the curvature of the tip 312. In the example of the present embodiment, the corona voltage threshold is about 2.5 kV with a wire diameter of the second electrode of 25 μm and a distance between the electrodes of 18 mm.

The electrical potential between the first electrode and the second electrode is maintained at a first electrical potential level which is less than and in the vicinity of an electrical potential threshold level at which at corona phenomenon is generated such that in the absence of smoke no corona phenomenon is generated in the vicinity of the second electrode and in the presence of smoke a corona phenomenon is generated in the vicinity of the second electrode.

The voltage applied between the first electrode (111, 211, 311) and the second electrode (112, 212, 312) is set to be less than the corona threshold in order to set the system in an intermediate state such that in the absence of smoke particles a corona phenomenon is not generated, while in the presence of smoke particles a corona phenomenon is generated.

The corona phenomenon is generated in the presence of smoke particles since the smoke particles become polarised by the strong electric field in the vicinity of the second electrode (112, 212, 312) thereby increasing the electric field in the detection zone DZ such that it exceeds the corona effect triggering threshold leading to the generation of a corona effect. This effect is detected by the amplifier 50 measuring the current and triggers an alarm to indicate the presence of smoke.

Figure 4:
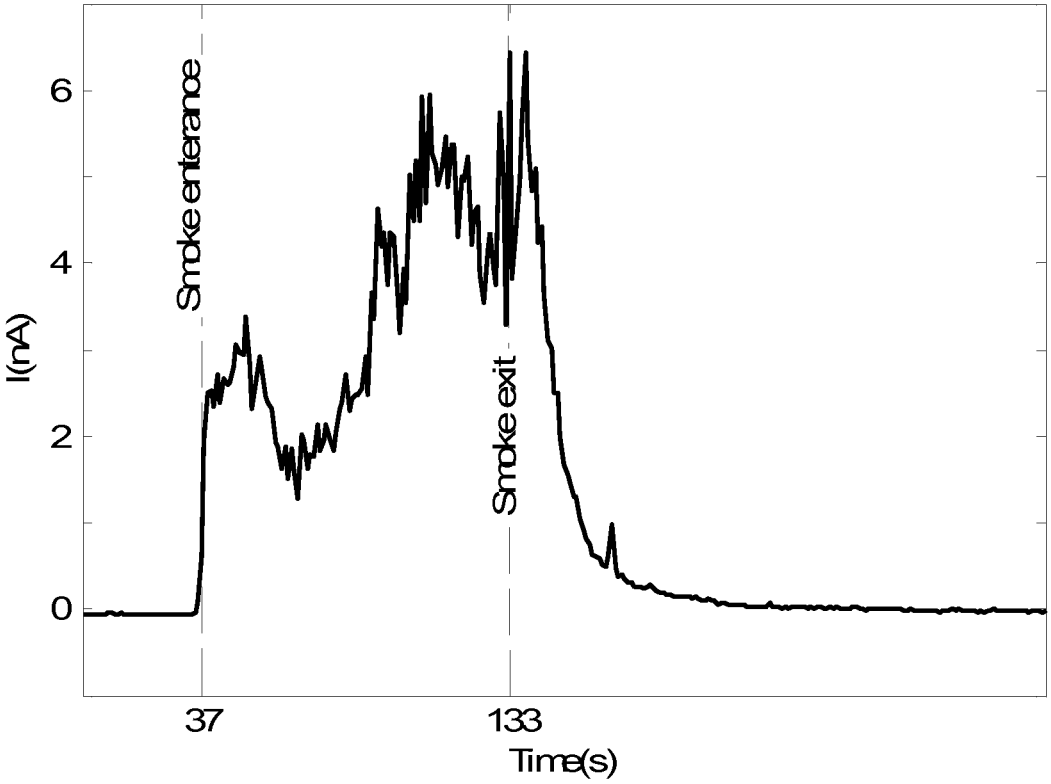
FIG. 4 is a graphical representation of a first example of a response of the smoke detector in the absence and presence of smoke particles.

A typical signal is presented in FIG. 4. In this example the second electrode is maintained at a voltage of 1000 V. In the absence of smoke there is no detectable signal. As soon as smoke particles enter the smoke detector a signal is clearly visible. When the source of the smoke is taken away, smoke particles still remains a few seconds in the sensor before being completely evacuated.

Figure 5:
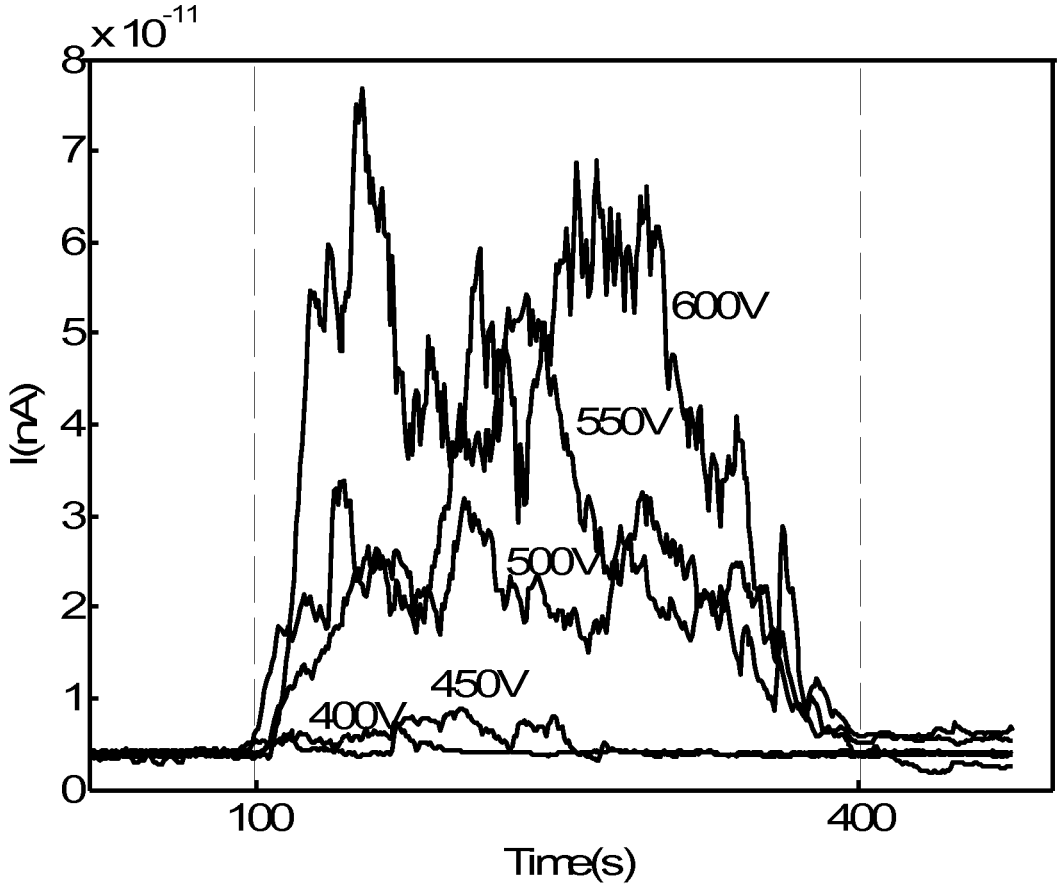
FIG. 5 is a graphical representation of a second example of a response of the smoke detector in the absence and presence of smoke particles.

FIG. 5 graphically illustrates the performance of a smoke detector according to an embodiment of the invention for different operating voltages applied to the second electrode. In the absence of smoke there is no detectable signal whatever voltage is applied between the electrodes. However after smoke has entered into the detection zone DZ of the smoke detector the signal greatly depends on the applied voltage. When voltage is less than or equal to 450 V, the smoke induced signal is relatively small. When the voltage is greater than 450 V however, the smoke induced signal increases with the applied voltage.

There is a clear threshold of ionization in presence of smoke particles which is much lower than the one in the absence of smoke particles.

Although the invention has been described with reference to specific embodiments it will be appreciated that the present invention is not limited to the specific embodiments, and modifications will be apparent to a skilled person in the art which lie within the scope of the present invention.

For instance, while in the foregoing examples have been described with relation to electrodes configured in a wire-plate, cylindrical or point-plate geometries, it will be appreciated that other suitable geometrical electrode configurations may be used to ionize air to provide a corona discharge such as a two-wire geometry or spherical geometry.

Many further modifications and variations will suggest themselves to those skilled in the art upon making reference to the foregoing illustrative embodiments, which are given by way of example only and which are not intended to limit the scope of the invention, that being determined solely by the appended claims. In particular the different features from different embodiments may be interchanged, where appropriate.

In the claims, the word "comprising" does not exclude other elements or steps, and the indefinite article "a" or "an" does not exclude a plurality. The mere fact that different features are recited in mutually different dependent claims does not indicate that a combination of these features cannot be advantageously used.

The invention claimed is:

1. A smoke detector comprising:

a housing provided with one or more openings for the passage of smoke particles into an interior of the housing;

a first electrode and a second electrode disposed in the interior of the housing for generating an electric field by application of an electrical potential therebetween;

a detection chamber defined between the first electrode and the second electrode, the detection chamber comprising an ionisation zone for the generation of charged particles by ionisation of air in the vicinity of the second electrode and a drift zone for the movement of charged particles towards the first electrode;

a measurement device for measuring an electrical parameter representative of the electrical current generated between the first electrode and the second electrode by the charged particles;

wherein the electrical potential between the first electrode and the second electrode is maintained at a first electrical potential level which is less than and in the vicinity of an electrical potential threshold level at which a corona phenomenon is generated such that in the absence of smoke no corona phenomenon is generated in the vicinity of the second electrode and in the presence of smoke the corona phenomenon is generated in the vicinity of the second electrode, and the difference in the measured electrical parameter between absence and presence of smoke is being determined and used to detect smoke.

2. A smoke detector according to claim 1, wherein the first electrode is of planar form and the second electrode is a wire arranged parallel to the first electrode.

3. A smoke detector according to claim 2, wherein the first electrode has a diameter in a range of from 30 mm to 50 mm and the second electrode has a diameter in a range of from 20 μm to 30 μm.

4. A smoke detector according to claim 1, wherein the first electrode is of cylindrical form and the second electrode is a wire disposed within the first electrode along the longitudinal axis of the first electrode.

5. A smoke detector according to claim 4, wherein the first electrode has a diameter in a range of from 30 mm to 50 mm and the second electrode has a diameter in a range of from 20 μm to 30 μm.

6. A smoke detector according to claim 4, wherein the first electrode is perforated.

7. A smoke detector according to claim 6, wherein the first electrode has a diameter in a range of from 30 mm to 50 mm and the second electrode has a diameter in a range of from 20 μm to 30 μm.

8. A smoke detector according to claim 1, wherein the second electrode is a conductor with a sharp tip facing towards the first electrode which has at least one portion of planar shape.

9. A smoke detector according to claim 8, wherein the second electrode has a curvature radius of the tip of less than 30 μm.

10. A smoke detector according to claim 1, wherein the second electrode is held at a positive electrical potential with respect to the first electrode.

11. A smoke detector according to claim 10, wherein the first electrical potential level is in a range of from 400V to 1000V with respect to the first electrode.

12. A smoke detector according to claim 1, further comprising a metallic shielding grid connected to ground potential to prevent the entrance of stray ions inside the detection chamber.

13. A smoke detector according to claim 1, wherein the electrical potential threshold level is in a range of from 400V to 500V.

14. A smoke detector according to claim 1, wherein the metallic grid shielding connected to ground potential surrounds the detection chamber.

* * * * *